United States Patent [19]

Jensen

[11] Patent Number: 4,811,499

[45] Date of Patent: Mar. 14, 1989

[54] HYGENIC PLASTIC FOOTWEAR INSERT

[76] Inventor: Harold A. Jensen, 31 Annadea Rd., Brockton, Mass. 02402

[21] Appl. No.: 181,917

[22] Filed: Apr. 15, 1988

[51] Int. Cl.[4] ..... A43B 17/14

[52] U.S. Cl. ..... 36/10; 36/9 A

[58] Field of Search ..... 36/10, 9 A, 9 R, 87; 2/49 R, 63, 243 B; 206/554; 383/906, 37

[56] References Cited

U.S. PATENT DOCUMENTS

| | | | |
|---|---|---|---|
| 2,952,926 | 9/1960 | Laven | 36/10 |
| 3,000,118 | 9/1961 | O'Shea | 36/10 |
| 3,312,339 | 4/1967 | Million | 206/554 |
| 4,006,823 | 2/1977 | Soto | 206/554 |
| 4,335,527 | 6/1982 | Pask | 36/7.1 R |
| 4,616,429 | 10/1986 | Alcala | 36/10 |
| 4,769,126 | 9/1988 | Roen et al. | 383/37 |

*Primary Examiner*—Steven N. Meyers

*Attorney, Agent, or Firm*—Samuels, Gauthier, Stevens & Kehoe

[57] ABSTRACT

The invention provides for a block-sealed hanger having a header. Depending from said header are paired two-ply inserts for use as foot prophylactics. The inserts having open inner edges which face one another, having the remaining edges sealed.

1 Claim, 1 Drawing Sheet

HYGENIC PLASTIC FOOTWEAR INSERT

BACKGROUND AND BRIEF SUMMARY OF THE INVENTION

In hospital examining rooms and the like, many times patients are required to move their footwear and hose. This results in the bare foot contacting the floor and other surfaces. Preferably some types of throw away or washable slippers are used to prevent transmission of infectious agents from contacting the surfaces. However, as a practical matter, even though current throw away slippers are relatively expensive and there is a tendency to use them, more often than not they are not purchased and therefore no protection is available.

Recently, public awareness of infectious diseases has increased such that those associated with the medical field are increasingly using prophylactic devices to protect themselves. In retail stores, certain items cannot be returned once worn by the purchaser. Also, stores selling footwear are becoming more concerned with the problem of transferring infection when several people try on the same footwear.

The present invention is directed to a method for the manufacture of a disposable insert used for footwear which is very inexpensive. The insert may be used for any form of footwear.

The insert is formed from a flexible film material which is slipper-like in configuration. Preferably, the insert is formed from a film which has therein thermal forming properties at room temperature whereby the insert will conform to the shape of the foot. Further, the insert is thin enough not to interfere with the normal foot-footwear size relationship.

In a particularly preferred embodiment, one side of the film has the property of frictionally engaging the skin of the foot and the other side of the film has the property of non-adhesion or sliding engagement with the surface of footwear. These properties in combination, the thermoplasticity, thickness and surface characteristics are all selected to ensure ease of insertion of the insert into the footwear and removal of the same.

The invention is made at least in part by the inventive disclosure of my co-pending application entitled Sealing Element for Angle Seals and T-shirt Bags, Ser. No. 184,077 filed Apr. 15, 1988 which is hereby incorporated by reference in its entirety in this application.

Broadly my invention comprises a block-sealed hanger having inserts depending therefrom on either side thereof. The inserts are joined to the header of the hanger by perforated release lines and include seal lines which form the toe and rear portions of the insert. The sides of the hanger, whether side gussetted or seamed, form the bottom or sole of the insert.

DESCRIPTION OF THE PREFERRED EMBODIMENT(S)

Figure 1:
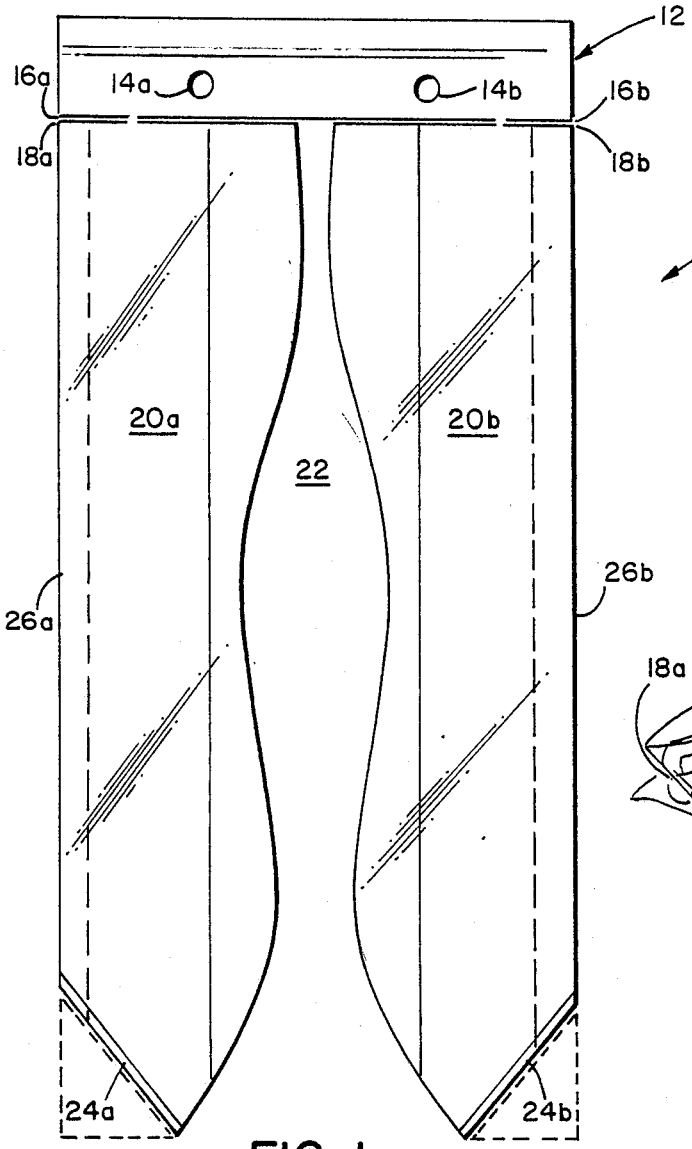
FIG. 1 is a front view of the block-sealed bundle of the invention.

Referring to FIG. 1, a bundle 10 of block-sealed inserts are shown at 10 and comprise a header 12 characterized by hang holes 14*a* and 14*b*. Inserts 20*a* and 20*b* are joined to the header 12 by perforated release lines 16*a* and 16*b*. Spaced apart from the release lines 16*a* and 16*b* are seals 18*a* and 18*b* formed by the sealing device of my co-pending application. These seals could be formed by hand. The other steps in the forming of the bundle 10 are known in the art.

The inserts 20*a* and 20*b* hang in spaced apart relationship and define an opening 22 therebetween. The depending outer sides of the inserts are characterized by sloped sides 24*a* and 24*b* formed by the sealing device and the triangular portions shown in dotted lines are removed by die cutting. The inserts include side gussetts 26*a* and 26*b*. The opening 22 is removed from the film when it is in its flat form by die cutting.

The inserts 20*a* and 20*b* being identical, only one will be described in detail. The insert is formed from a HPDE film 0.0007 mills. Other suitable films include any of the polyethylenes or other films used in converting.

Figure 2:
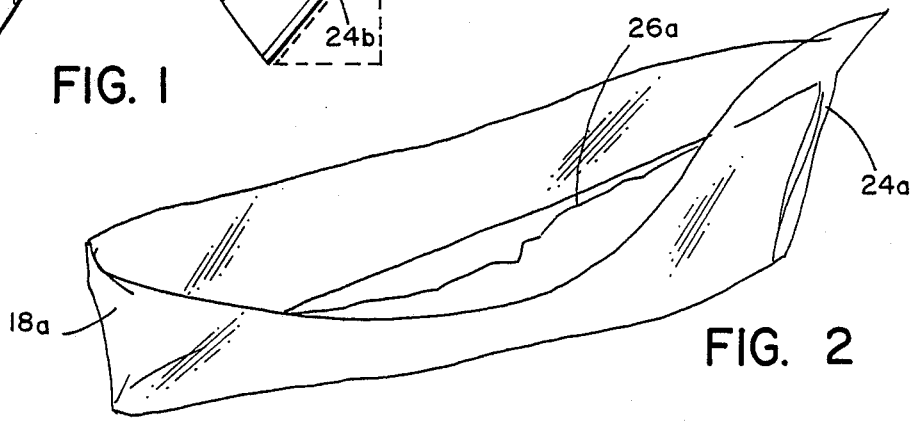
FIG. 2 is a perspective view of an insert formed according to the teachings of the invention.

Referring to FIG. 2, the seal line 18*a* comprises the toe portion, the side gussett 26*a* forms the bottom or sole of the insert and the seal line 24*a* forms the back portion.

Figure 3:
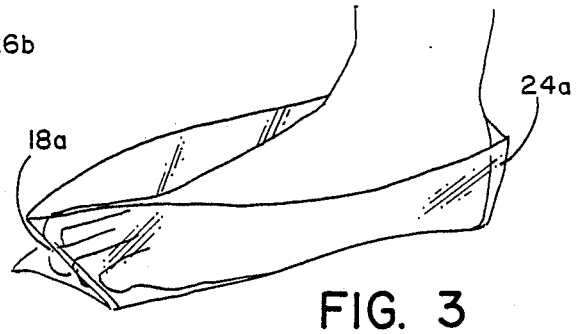
FIG. 3 is a side view of the insert used with footwear.

As shown in FIG. 3, the foot is completely substantially enveloped by the insert.

Although the invention has been described in reference to side-gussetted bags, it is within the scope of the invention that single seam bags may be used. Further, other shapes may be used other than that shown and further the recesses 24*a* and 24*b* may be eliminated entirely.

Having described my invention, what I now claim is:

1. A block-sealed hanger for footwear inserts which comprises:

a header;

paired two-ply inserts depending from said header and secured thereto by release lines, said inserts having open inner edges facing one another to define the opening of each respective insert, sealed outer edges defining the sole of the insert;

a first seal line spaced apart from said release line forming one end of the insert; and a second seal line spaced apart from the first seal line defining the other end of the insert.

* * * * *